US007377029B2

(12) United States Patent
Liu

(10) Patent No.: US 7,377,029 B2
(45) Date of Patent: May 27, 2008

(54) WIRE WINDING DEVICE FOR ELECTRICAL COMPONENTS

(75) Inventor: Lu-Ta Liu, Taipei (TW)

(73) Assignee: Lankom Electronics Co., Ltd., Taipei (TW)

( * ) Notice: Subject to any disclaimer, the term of this patent is extended or adjusted under 35 U.S.C. 154(b) by 185 days.

(21) Appl. No.: 11/364,110

(22) Filed: Feb. 27, 2006

(65) Prior Publication Data

US 2007/0199193 A1 Aug. 30, 2007

(51) Int. Cl.
*H01F 41/08* (2006.01)

(52) U.S. Cl. ..... 29/745; 29/33 F; 29/605; 140/71 C; 140/102; 140/124; 226/181; 226/188; 242/445; 242/445.1; 242/447

(58) Field of Classification Search ..... 29/33 F, 29/745, 755, 605; 140/71 C, 92.1, 102, 103, 140/124; 226/176, 177, 181, 186, 187, 188; 242/442, 445, 445.1, 447, 447.1
See application file for complete search history.

(56) References Cited

U.S. PATENT DOCUMENTS 3,732,901 A * 5/1973 Kent et al. ..... 140/92.1
3,985,310 A * 10/1976 Kent et al. ..... 242/434.7

* cited by examiner

*Primary Examiner*—Peter Vo
*Assistant Examiner*—Livius R. Cazan
(74) *Attorney, Agent, or Firm*—James H. Walters

(57) ABSTRACT

A wire winding device for electrical components has a transmission member, a wire feeding member, a wire winding member, a spool feeding member, and a driving member. Spools are respectively inserted into the wire winding member via the spool feeding member and rotated by the driving member. Wires are moved into the wire winding member via the wire feeding member and inserted into the spool. Hence, the wire can be encircled the spool automatically.

7 Claims, 16 Drawing Sheets

WIRE WINDING DEVICE FOR ELECTRICAL COMPONENTS

BACKGROUND OF THE INVENTION

1. Field of the Invention

The present invention relates to a wire winding device for electric components, and more particularly to a wire winding device for winding wires around spools for waves filtering coils.

2. Description of the Related Art

Wave filtering coils are usually used for electrical cards. Each wave filtering coil comprises a loop and a wire encircled the loop. The wire is manually encircled on the periphery of the loop. However, the loop has a small volume, such that to reel the wire onto the loop manually is time-consuming.

Therefore, the invention provides a wire winding device for electrical components to mitigate or obviate the aforementioned problems.

SUMMARY OF THE INVENTION

The main objective of the present invention is to provide a wire winding device for electrical components which is easy for wires being encircled onto the periphery of a loop automatically.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
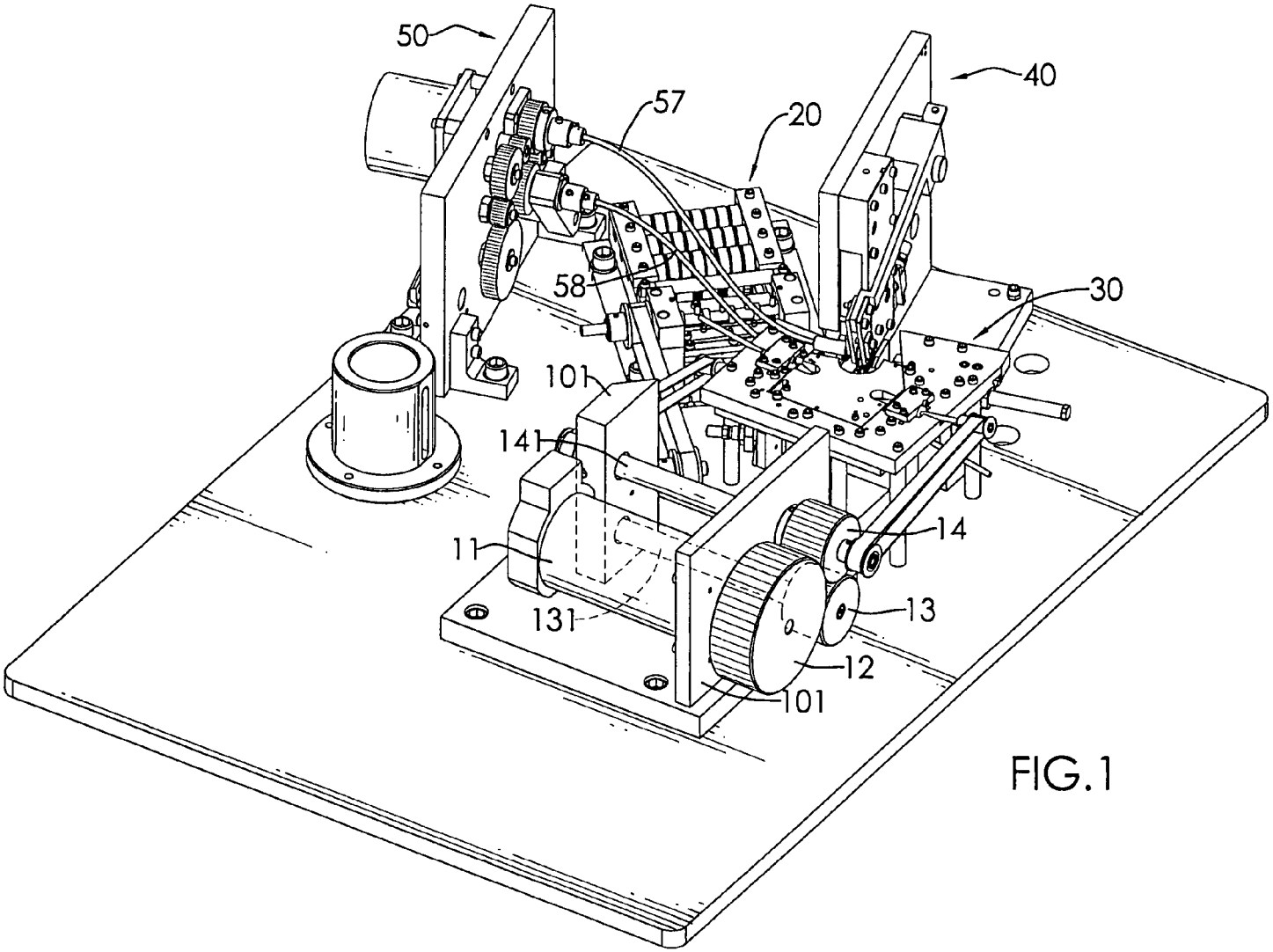
FIG. 1 is a perspective view of a wire winding device for electrical components in accordance with the present invention.
Figure 2:
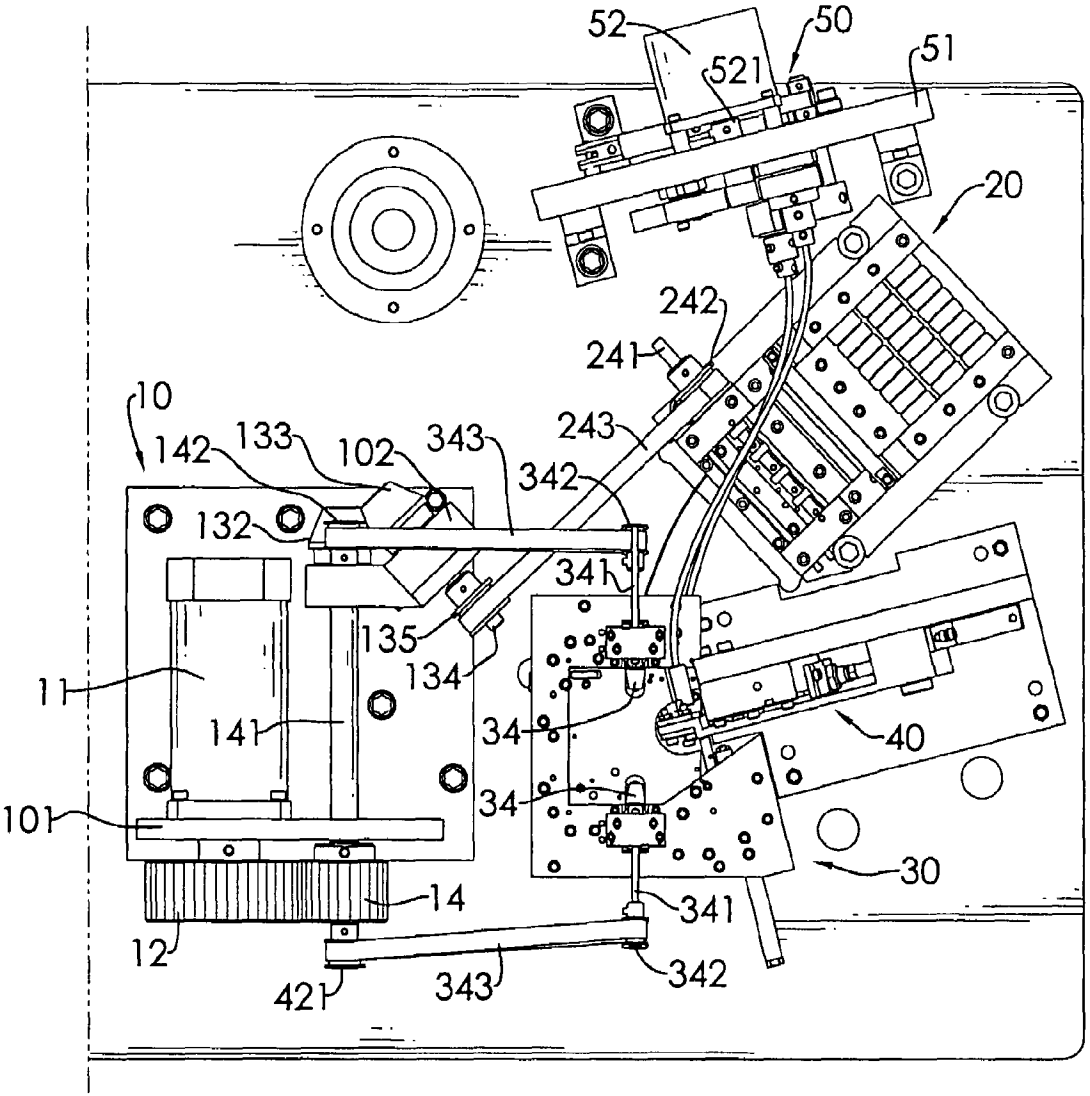
FIG. 2 is a top view of the wire winding device for electrical components in FIG. 1.
Figure 3:
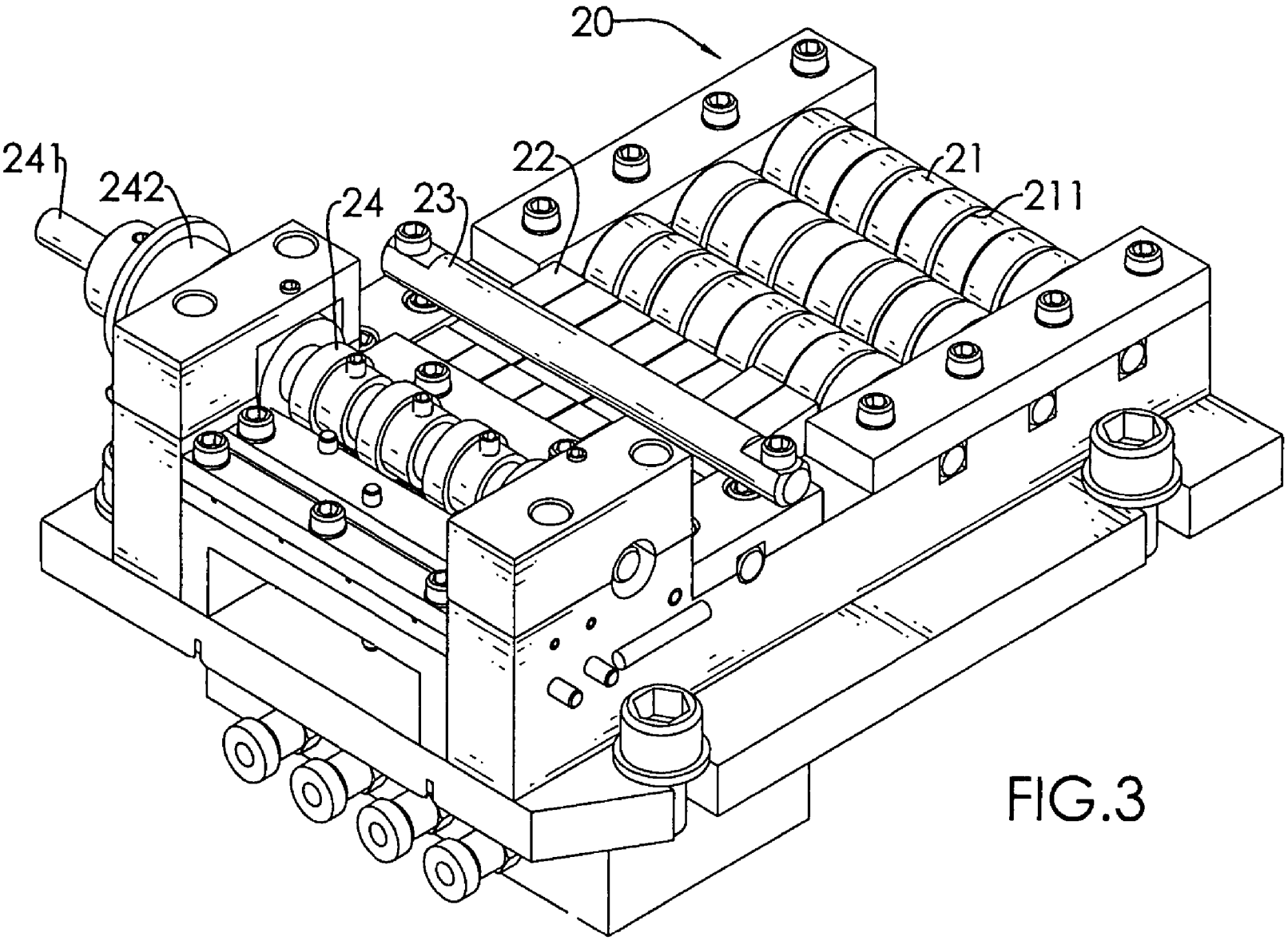
FIG. 3 is a perspective view of a wire feeding member of the wire winding device in FIG. 1.
Figure 4:
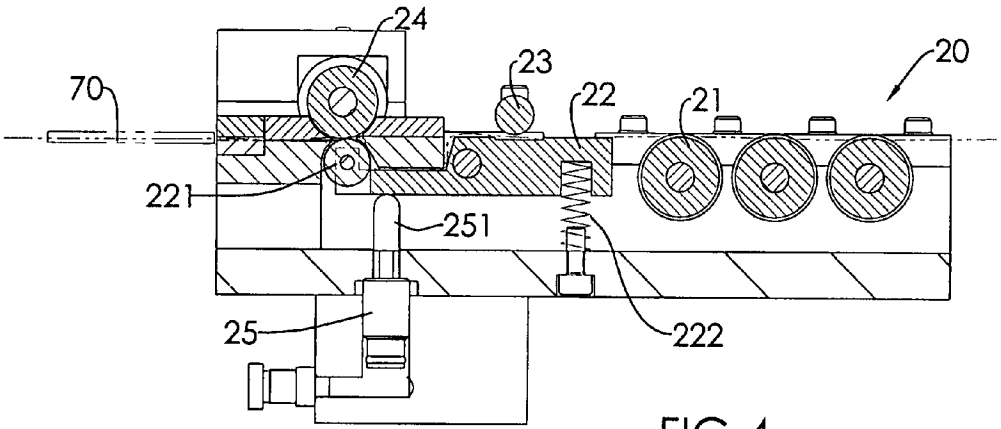
FIG. 4 is an operational side view in a partial cross section of the wire feeding member of the wire winding device in FIG. 1.

With reference to FIGS. 1-2, a wire winding device for electrical components comprises a transmission member (10), a wire feeding member (20), a wire winding member (30), a spool feeding member (40), and a driving member (50).

The transmission member (10) is mounted on a base and has a first motor (11) and two upright first flats (101). A male wheel (12), a wire feeding wheel (13) and a wire winding wheel (14) are respectively mounted at one of the first flats (101) and the wire feeding wheel (13) has multiple teeth, and the wire winding wheel (14) has multiple teeth. The male wheel (12) has multiple teeth engaging with the teeth on the feeding wheel (13) and the wire winding wheel (14) simultaneously. In a preferred embodiment, the amount of the teeth on the feeding wheel (13) is same as that of the teeth on the wire winding wheel (14). The first motor (11) is mounted between the first flats (101) and is connected to the male wheel (12) which is respectively mated with the wire feeding wheel (13) and the wire winding wheel (14). A first and a second sector wheels (132, 133) are mated with each other, and the second sector is mounted at a bracket (102). A shaft (134) is inserted through the bracket (102). A first axle (131) is inserted through the first flats (101) and a first end of the first axle (131) is inserted into a center of the wire feeding wheel (13) while a second end of the first axle (131) is inserted into the first sector wheel (132). A first end of the shaft (134) is inserted into the second sector wheel (133) and a second end of the shaft (134) is inserted into a first belt wheel (135). A second axle (141) is inserted through the first flats (101), and a first end of the second axle (14) is inserted into the wire winding wheel (14) and a second end of the second axle (14) is inserted into a second belt wheel (142).

With reference to FIGS. 2-5, the wire feeding member (20) has a base, multiple posts (21) parallel to each other and mounted at a first end of the base and multiple soft tubes (70) mounted at and extended out of a second end of the base. Each post (21) has multiple evenly-spaced annular channels (211) radially defined therein and parallel to each other. A disk (22) is pivotally mounted on the base adjacent to the posts (21). A supporting shaft (221) is mounted on the base and abuts a first end of the disk (22) opposite to the posts (21), and a spring (222) is mounted in the base and is located under and supports a second end of the disk (22) adjacent to the posts (21). A first pressured cylinder (25) is mounted at a lower end of the body of the wire feeding member (20) and substantially under the supporting shaft (221). A pushing shaft (251) is formed at and extends upward from a top end of the first pressured cylinder (25) and extends toward the disk (22). A pressing shaft (23) is mounted on the body and abuts against the top of the disk (22). A first friction wheel (24) is rotatably mounted on the body of the wire feeding member (20) and over the supporting shaft (221). A spindle (241) is transversely mounted on a center of the friction wheel (24) and extends out of the body of the wire feeding member (20). A third belt wheel (242) is mounted around the spindle (241), and a first belt is mounted around and between the first belt wheel (135) and the third belt wheel (242). The first belt wheel (135) has a diameter same as that of the third belt wheel (242).

Figure 7:
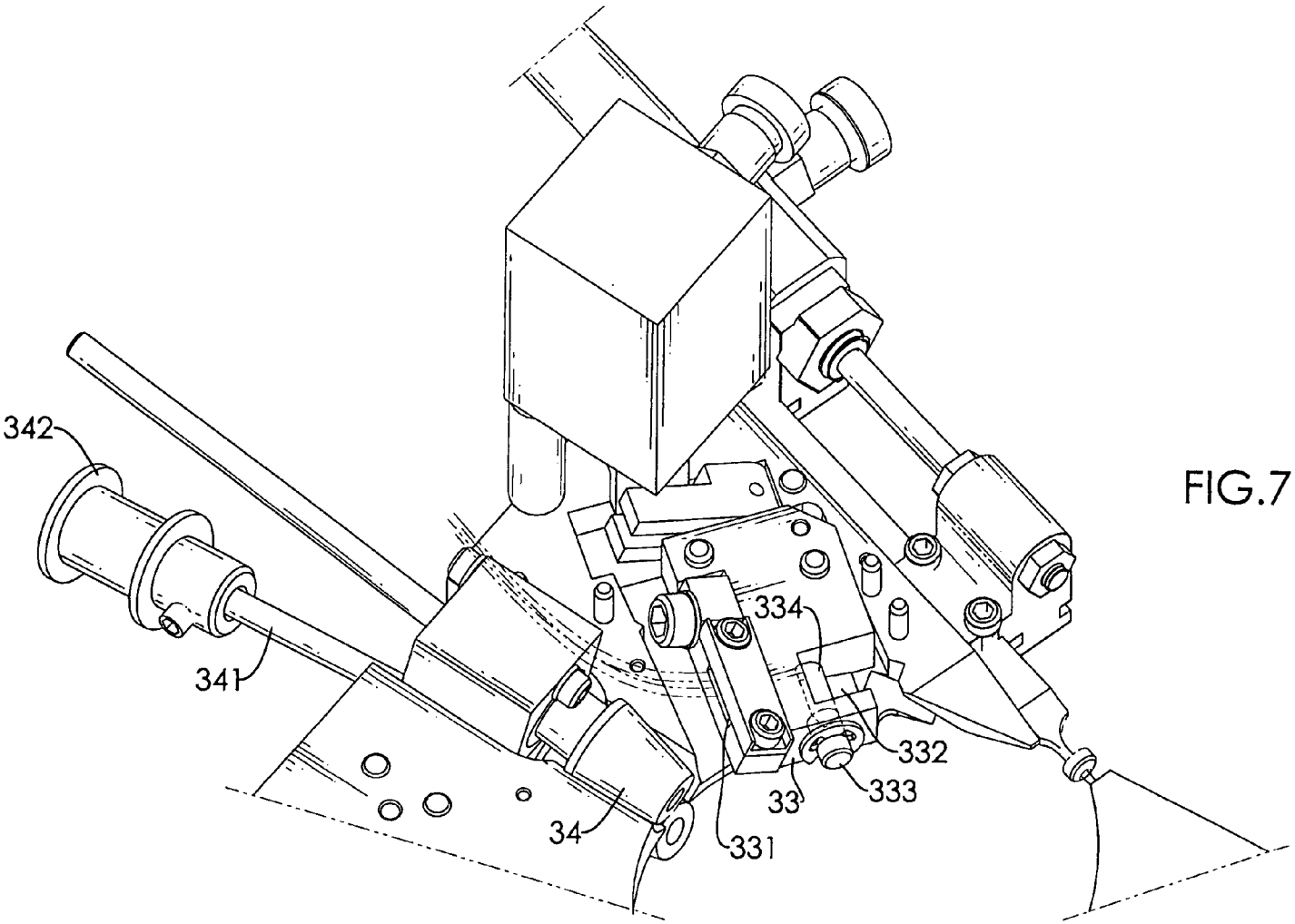
FIG. 7 is a partially bottom perspective view of a wire winding member of the wire winding device in FIG. 1.
Figure 8:
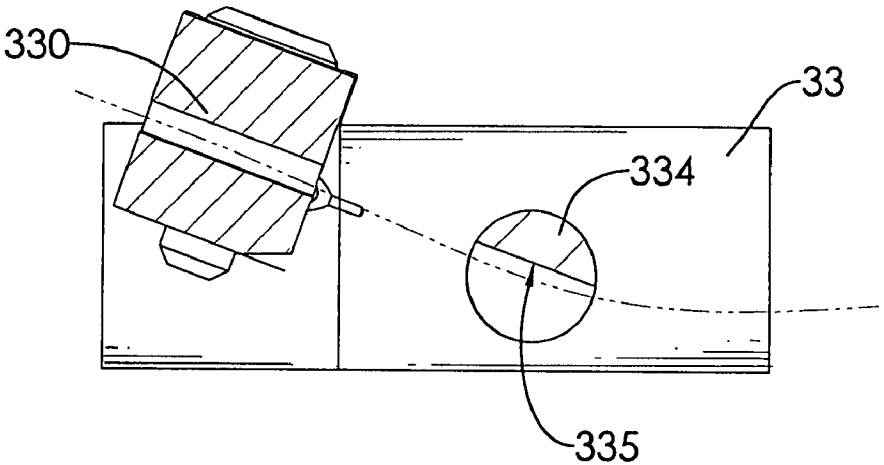
FIG. 8 is an operational cross sectional side view of a block of the wire winding member of the wire winding device in FIG. 1.
Figure 9:
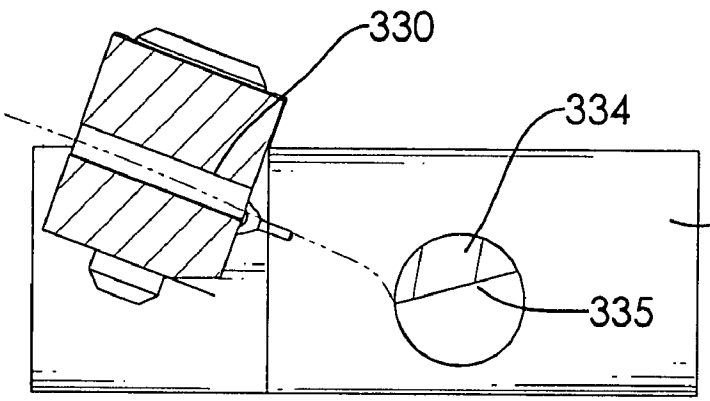
FIG. 9 is an operational cross sectional side view of the block of the wire winding member of the wire winding device in FIG. 1.
Figure 10:
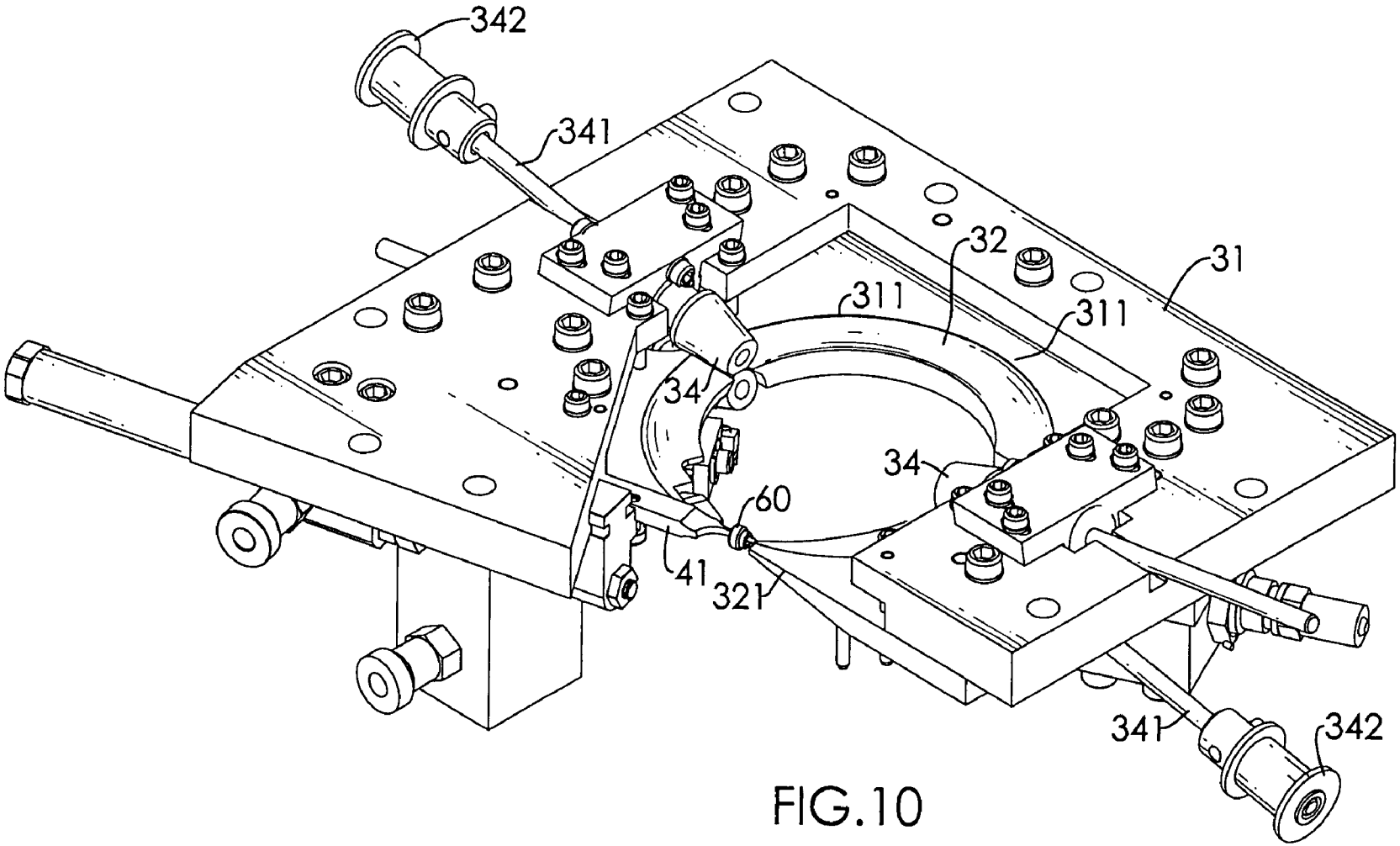
FIG. 10 is a perspective view of the wire winding member of the wire winding device in FIG. 1.
Figure 11:
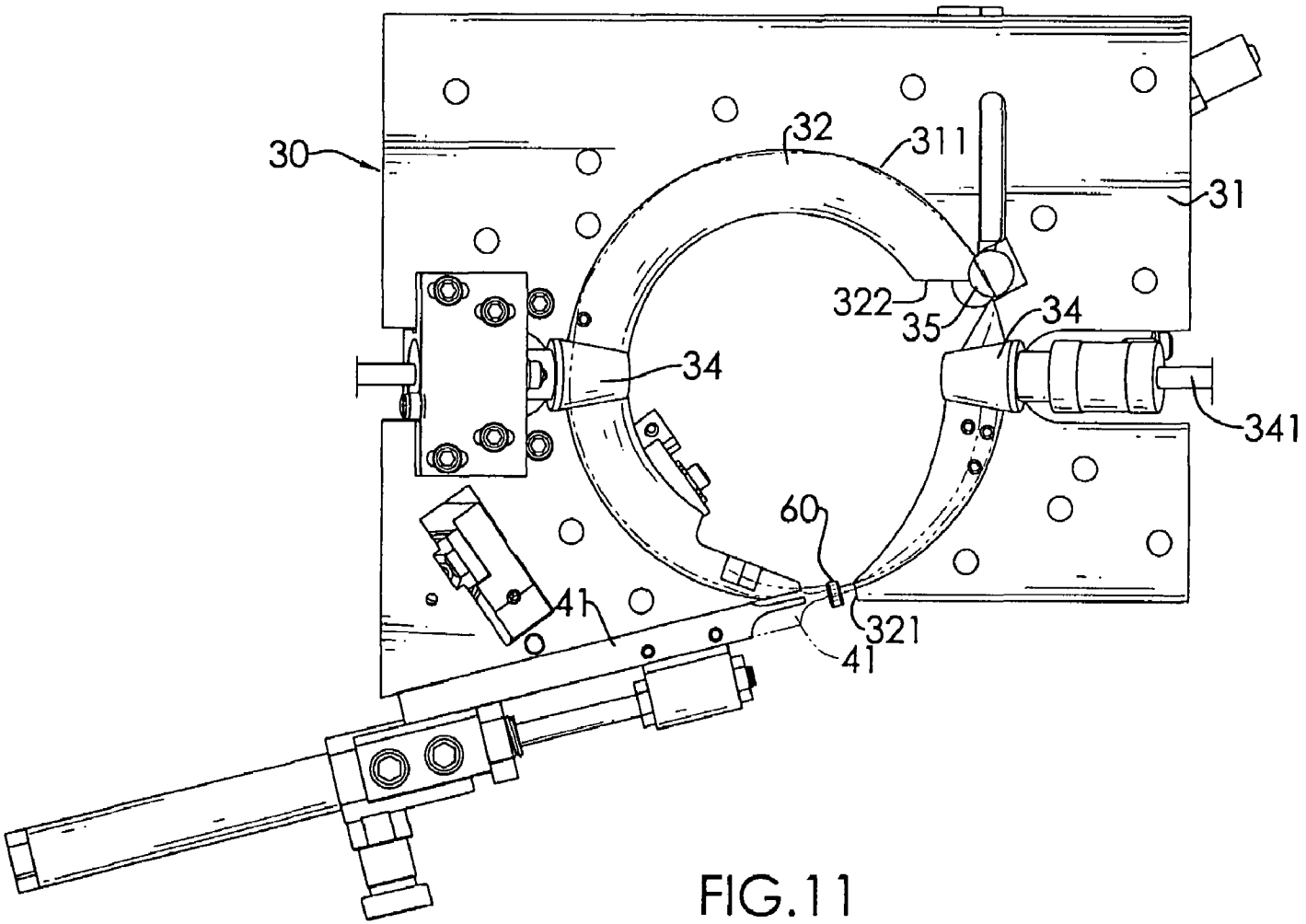
FIG. 11 is a top view of the wire winding member of the wire winding device in FIG. 1.
Figure 12:
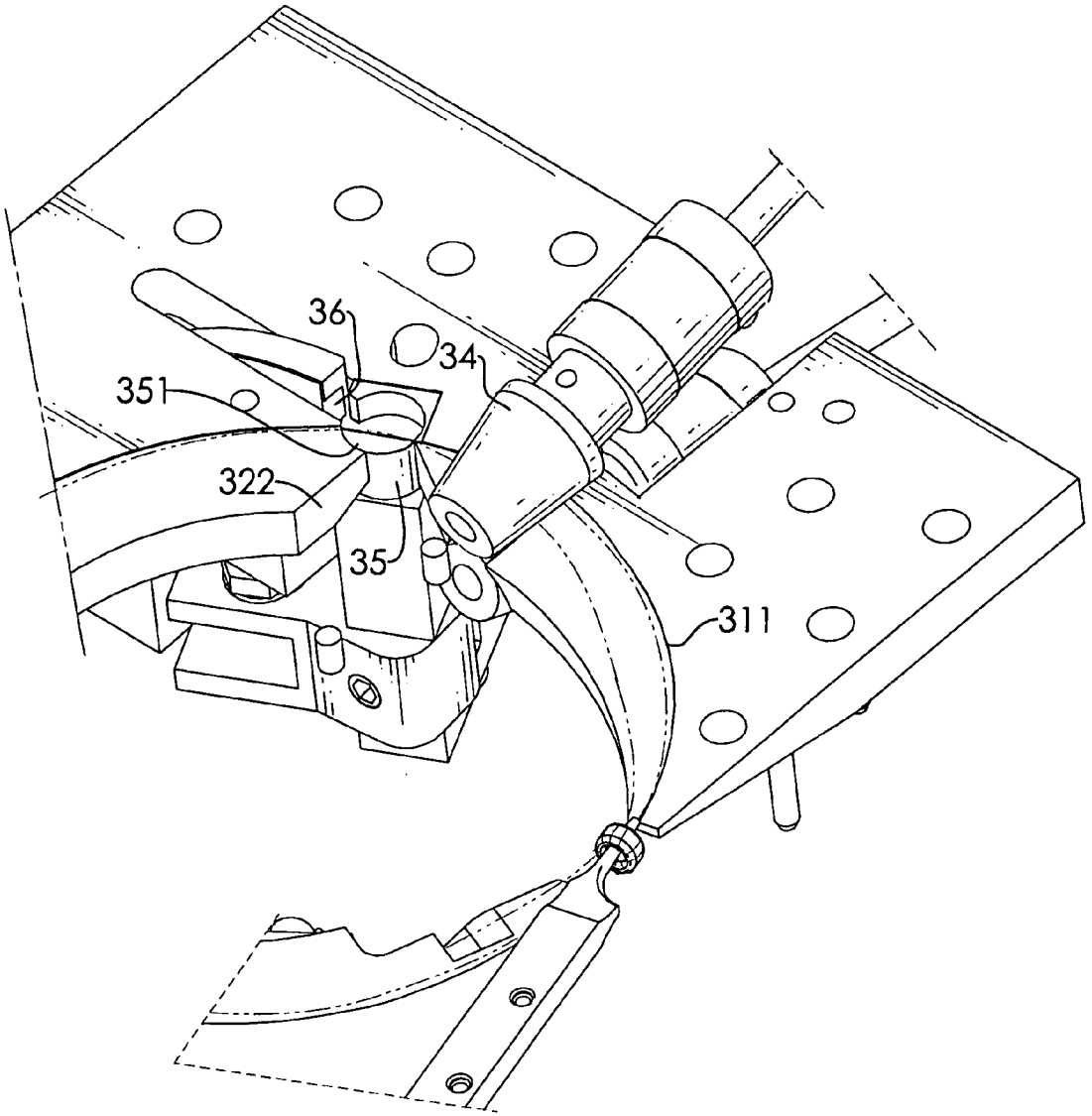
FIG. 12 is a partially top perspective view of the wire winding member of the wire winding device in FIG. 1.
Figure 14:
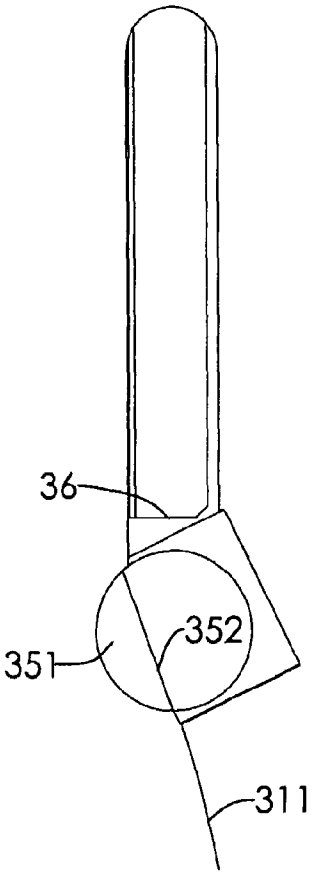
FIG. 14 is an operational side view of the wire cutting member of the wire winding device in FIG. 1.
Figure 13:
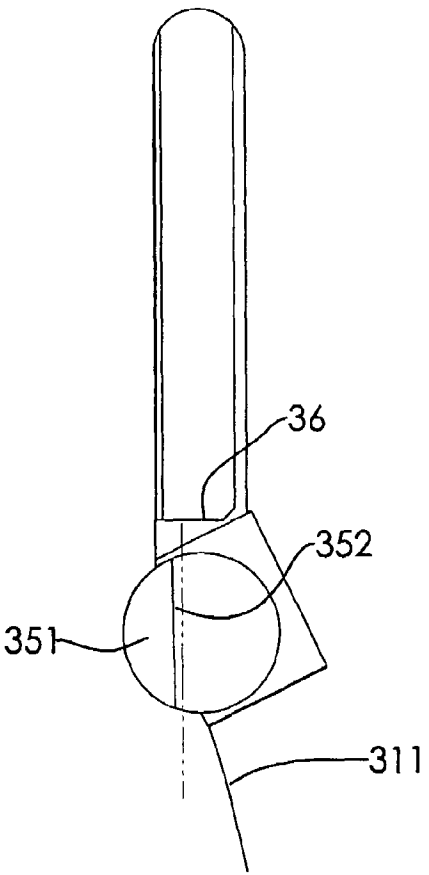
FIG. 13 is an operational side view of a wire cutting member of the wire winding device in FIG. 1.
Figure 15:
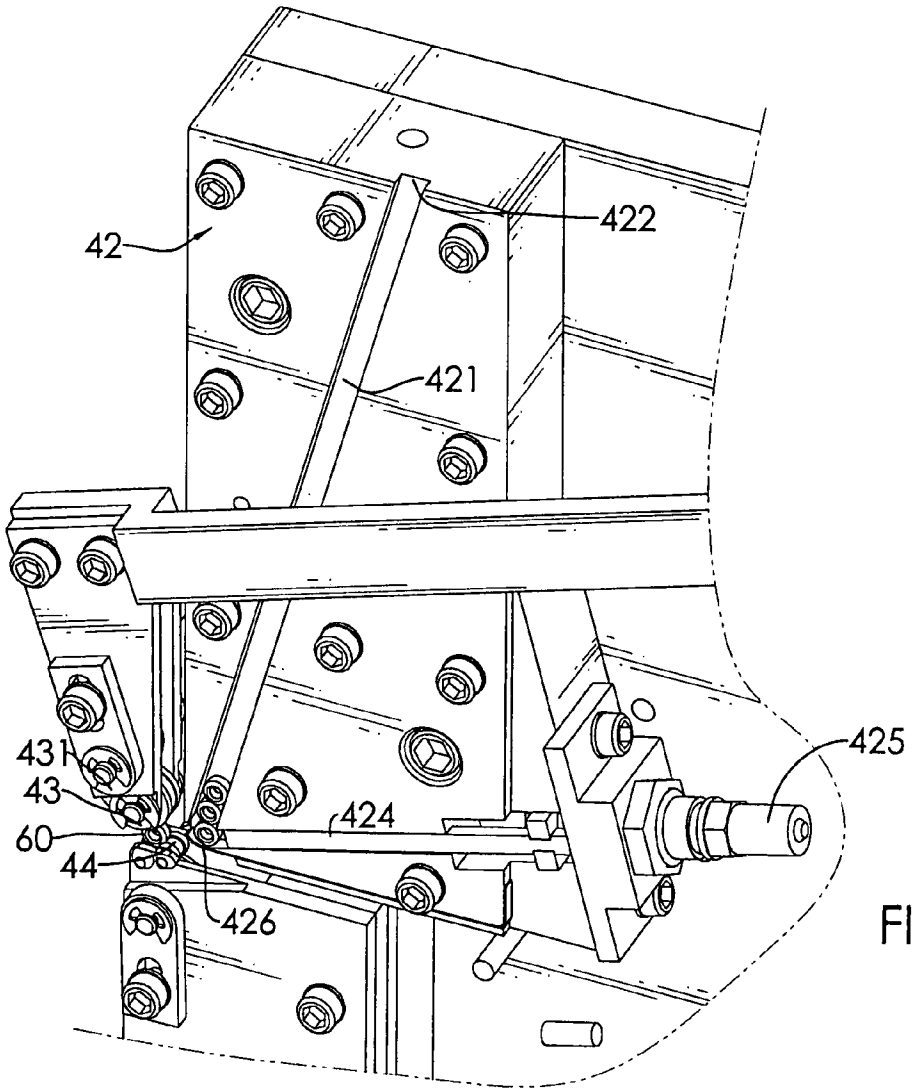
FIG. 15 is a perspective view of a spool feeding member of the wire winding device in FIG. 1.

With reference to FIGS. 7, 10 and 11, the wire winding member (30) has a hollow support (31) and a wire winding disk (32) mounted in the support (31). The wire winding disk (32) has a slightly thinner thickness than that of the support (31) so that a first step (311) is formed in interconnecting surfaces of the wire winding disk (32) and the support (31).

With reference to FIGS. 5, 7-9, the support (31) has a block (33) which is formed at a lower end of the support (31) and extends towards an upper end of the wire winding disk (32). Multiple wire grooves (330) are respectively defined in the block (33), and a wire inlet (331) and a wire outlet (332) are respectively defined in two ends of each wire groove (330). The wire inlet (331) is defined at a lower end of the block (33) that extends to the bottom of the support (31), and the wire outlet (332) is defined at an upper end of the block (33) that extend to the top of the support (31). The soft tubes (70) respectively extend toward the wire inlets (331). A wire cutting element (333) is rotatably mounted in the block (33) and adjacent to the wire outlets (332). A semi-circular post (334) is formed at an end of the wire cutting element (333) which is inserted into the block (33) and a wire cutting surface (335) is formed at a side of the semi-circular post (334).

With further reference to FIGS. 2, 3, 10 and 11, two first holes are respectively defined in a periphery of the support (31) and opposite to each other while two second holes are respectively defined in a periphery of the wire winding disk (32) and corresponding to the first holes. Multiple second friction wheels (34) are respectively received into the first and the second holes and mounted on the first step (311). Two mandrels (341) are respectively mounted at ends of two of the second friction wheels (34) and extend out of the support (31). Two fourth belt wheels (342) are respectively mounted around the mandrels (341) and correspond respectively to the second belt wheels (142). Each corresponding pair of the second belt wheel (142) and the fourth belt wheel (342) is encircled by a second driving belt (343) so that each fourth belt wheel (342) is driven by the corresponding second belt wheel (142) via the second driving belt (343). The second belt wheels (142) have a bigger diameter than the fourth belt wheels (342) so that the mandrels (341) rotate more quickly than the second axles (141) and the second friction wheels (34) rotate more quickly than the first friction wheels (24).

With reference to FIGS. 11-14, a cutout (321) is defined in a periphery of the wire winding disk (32). A gap (322) is defined in the periphery of the wire winding disk (32) and apart from the cutout (321). A wire cutting member (35) is mounted on the support (31) and extending into the gap (322). A plane (351) is formed at an end of the wire cutting member (35) and lower than the periphery of the support (31). A second step (352) is formed at a top end of the plane (351) and corresponds to the first step (311). A wire-out gap (36) is defined in the support (31) and aims to the wire cutting member (35).

With reference to FIGS. 2, 11, 15-17, the spool feeding member (40) is mounted on the support and corresponds to the cutout (321). The spool feeding member (40) has a needle (41) mounted on the support (31) and inserted into the cutout (321). The spool feeding member (40) has a box (42) and a slot (421) defined in a periphery of the box (42). A spool inlet (422) is defined in a top end of the box (42) and in communication with the slot (421). A spool outlet (423) is defined in a side of the box (42) and communicates with the slot (421). A pushing bar (424) is connected to a second pressured cylinder (425) and inserted into the spool outlet (423). A resilient piece (426) is securely mounted in the box (42) and has a curved end which is mounted between the slot (421) and the spool outlet (423).

Figure 17:
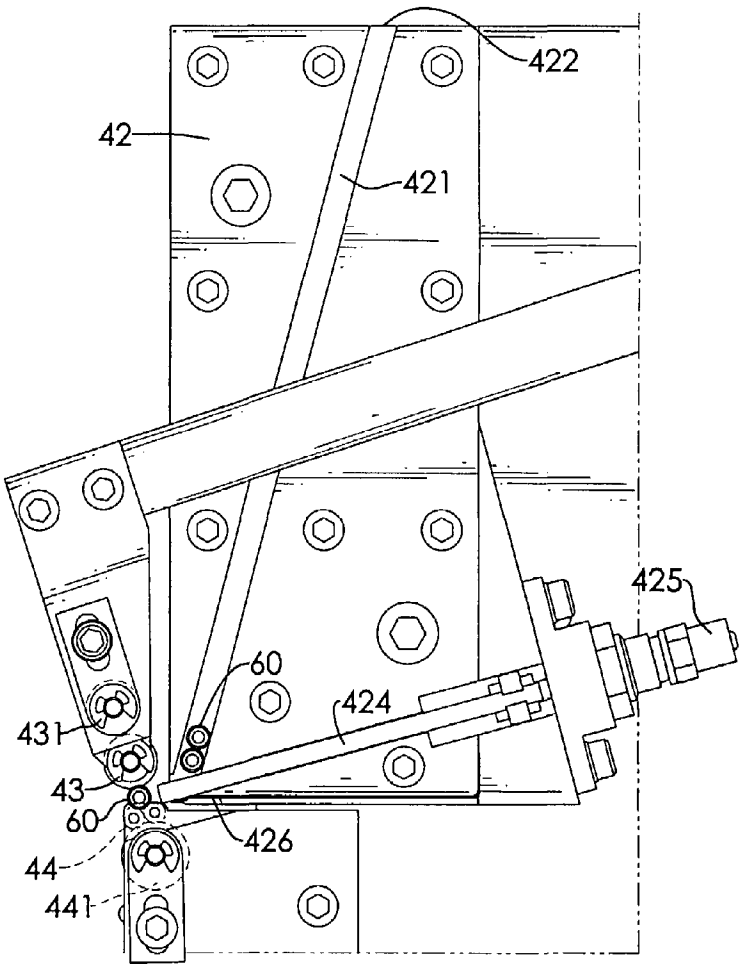
FIG. 17 is an operational front view of the spool feeding member of the wire winding device in FIG. 1.
Figure 16:
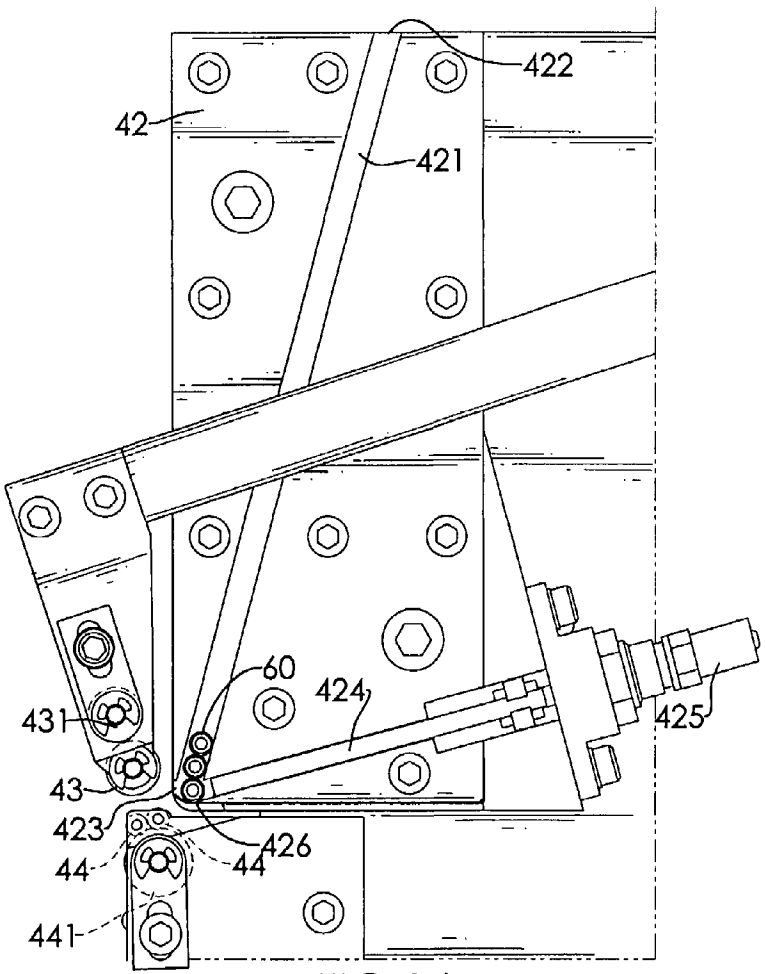
FIG. 16 is an operational front view of the spool feeding member of the wire winding device in FIG. 1.

With reference to FIGS. 11, 16 and 17, an upper wheel (43) is mounted at an upper end of the cutout (321) and mated with an upper driving wheel (431). Two lower wheels (44) are respectively mounted at a lower end of the cutout (321) and unengaged with each other. The lower wheels (44) are respectively mated with a lower driving wheel (441) which is mounted under the lower wheels (44).

With reference to FIGS. 2, 17-20, the driving member (50) is mounted at a side of a second flat (51) and a second motor (52) is mounted at the second flat (51) and opposite to the spool feeding member (40). A wheel unit (53) is mounted at the second flat (51) and adjacent to the spool feeding member (40). The wheel unit (53) has a first wheel (531), a second wheel (532), a third wheel (533), a fourth wheel (534), a fifth wheel (535) and a sixth wheel (536). The second wheel (532) and the third wheel (534) are respectively mated with the first wheel (531). The second wheel (532) is also mated with the fourth wheel (534) while the third wheel (533) is also mated with the fifth wheel (535) which is mated with the sixth wheel (536). A central spindle (521) extends out of the second motor (52) and inserted through the second flat (51). A pivotal shaft (54) is inserted through the second flat (51) and adjacent to the second motor (52) and securely mounted at a pushing plane (541). A third pressured cylinder (55) is mounted adjacent to the second motor (52) and a bar (551) extending out of the third pressured cylinder (55) is connected to the pushing plane (541). A first end of a pivotal plane (542) is connected to the pivotal shaft (54) and a second end of the pivotal plane (542) is connected to a pivotal wheel (56).

Figure 18:
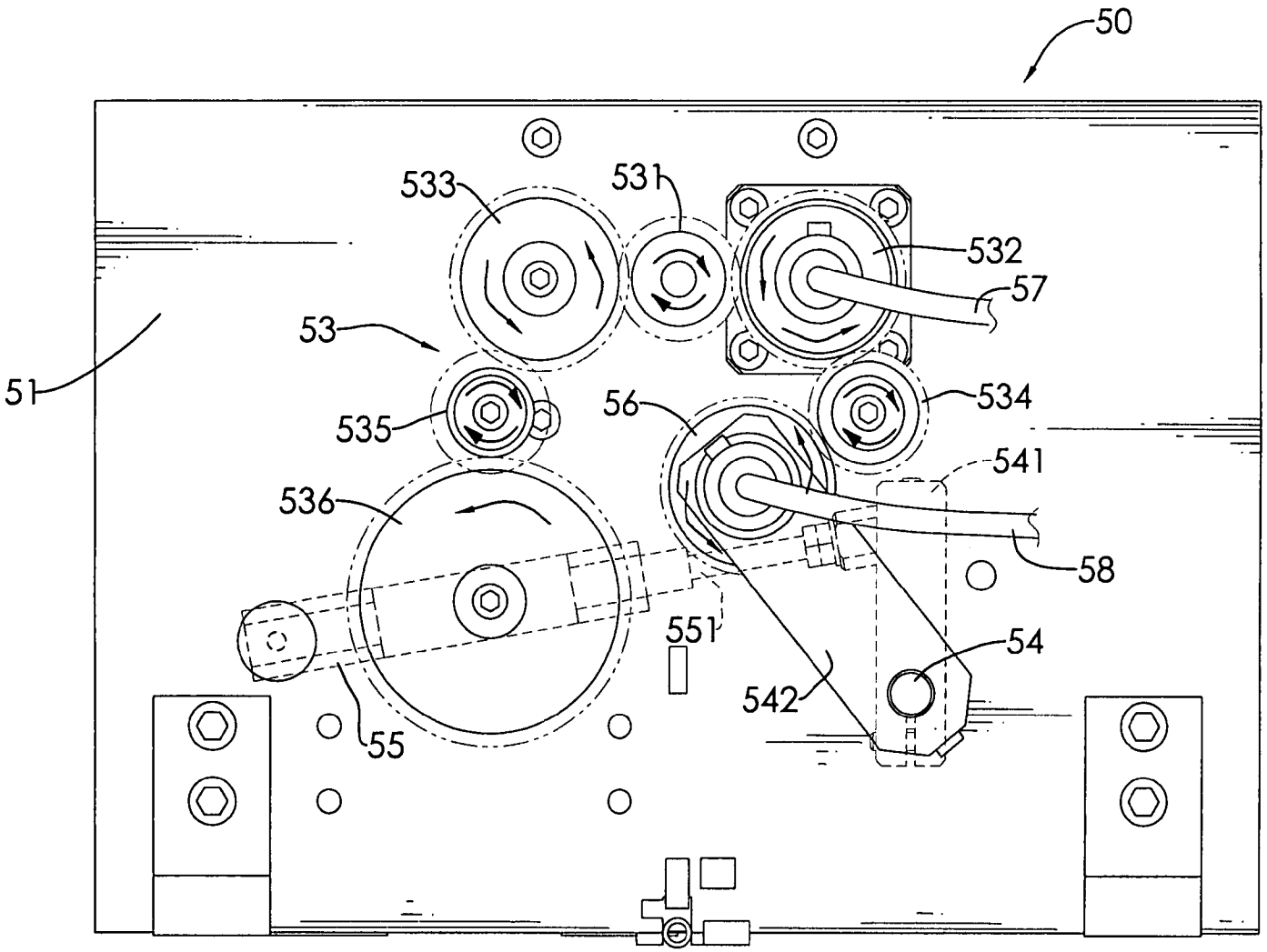
FIG. 18 is an operational side view of a driving member of the wire winding device in FIG. 1.

With reference to FIGS. 1, 16 and 18, the upper driving wheel (431) is connected to the second wheel (532) with a first soft driving shaft (57) while the pivotal wheel (56) is connected to the lower wheel (441) with a second soft driving shaft (58).

With reference to FIGS. 15-18, a spool (60) is inserted into the slot (421) via the spool inlet (422) and stopped by the resilient piece (426). The second pressured cylinder (425) is driven by a PLC (programmable logic controller) and the pushing bar (424) is driven by the second pressured cylinder (425) to push the spool (60) forwards and push aside the resilient piece (426) so that the spool (60) slides between the upper wheel (43) and the lower wheels (44).

With further reference to FIG. 11, the needle (41) is driven to extend toward the cutout (321) thereby inserted into the spool (60) so that the spool (60) can not separate from the upper driving wheel (43) and the lower driving wheel (44).

Figure 19:
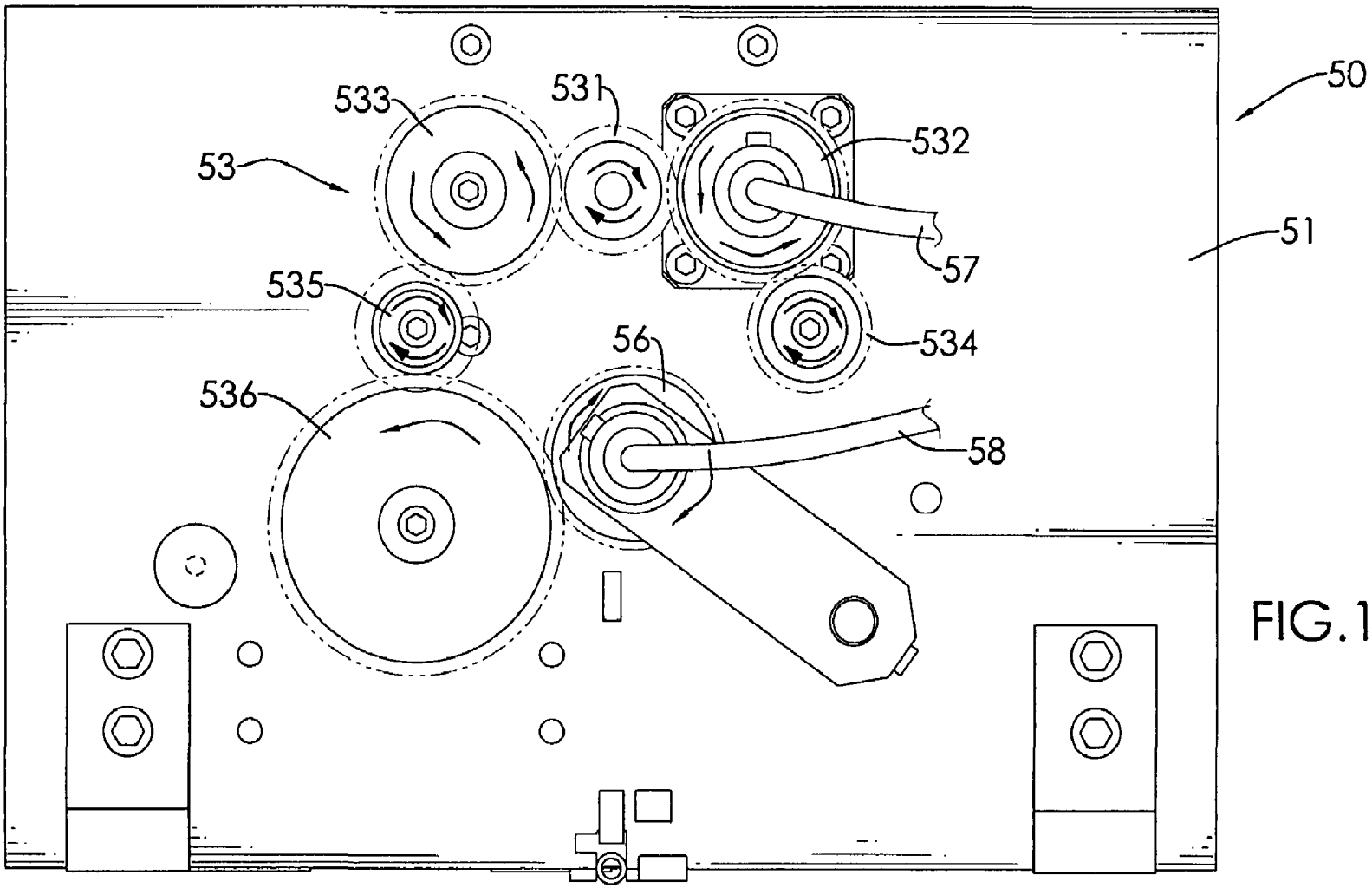
FIG. 19 is an operational side view of the driving member of the wire winding device in FIG. 1.
Figure 20:
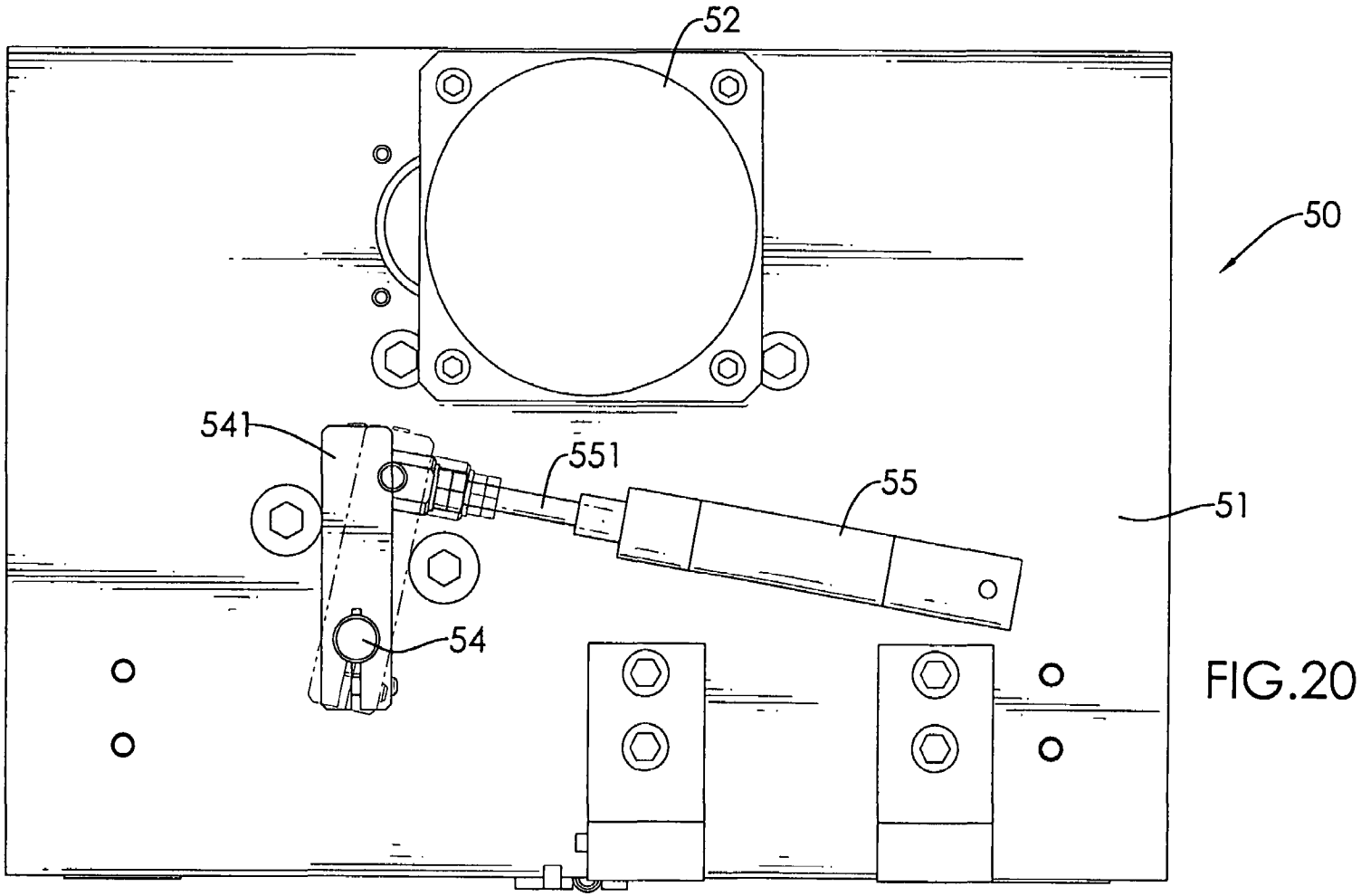
FIG. 20 is an operational side view of the driving member of the wire winding device in FIG. 1.

With reference to FIGS. 18-20, the third pressured cylinder (55) is driven by the PLC to push the bar (551) and the pushing plane (541). The pivotal shaft (54) is rotated via the pushing plane (541) so that the pivotal plane (542) is pivoted and the pivotal wheel (56) is mated with the fourth wheel (534). The pivotal wheel (56) is rotated with the second wheel (532) in a same direction so that the upper wheel (43) rotates with the lower wheel (44) in a same direction. Hence, a lower end of the upper wheel (43) rotates with an upper end of the lower wheel (44) in a different direction so that the spool (60) rotates between them.

With reference to FIGS. 2-5, a wire is encircled around the channel (211) and moved onto the disk (22) and adjacent to the pressing shaft (23). The wire then passes between the supporting shaft (221) and the first friction wheel (24). The first pressured cylinder (25) is driven by the PLC so that the pushing shaft (251) is pushed upwards and presses against the disk (22) upwards. Hence, the wire is aimed to and moved into the soft tube (70) via the rotation of the first friction wheel (24).

With reference to FIGS. 6-9, the wire passes through the soft tube (70) and moves into one of the wire inlets (331). The wire extends into the corresponding wire groove (330) and passes through a side of the wire cutting surface (335) and out of the corresponding wire outlet (332).

With reference to FIGS. 7, 10, 11 and 15, the wire is moved into the wire winding disk (32) via the wire outlet (332) and along the first step (311) to pass between the second friction wheels (34) and wire winding disk (32). The second friction wheels (34) rotate more quickly than the first friction wheels (24) so that the wire is tightly encircled the periphery of the spool (60) to form wave filtering coils.

Figure 5:
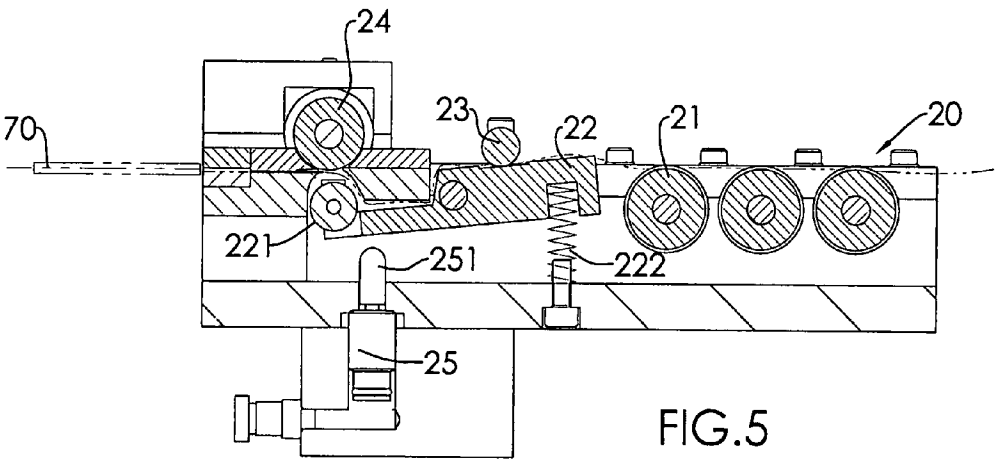
FIG. 5 is an operational side view in a partial cross section of the wire feeding member of the wire winding device in FIG. 1.
Figure 6:
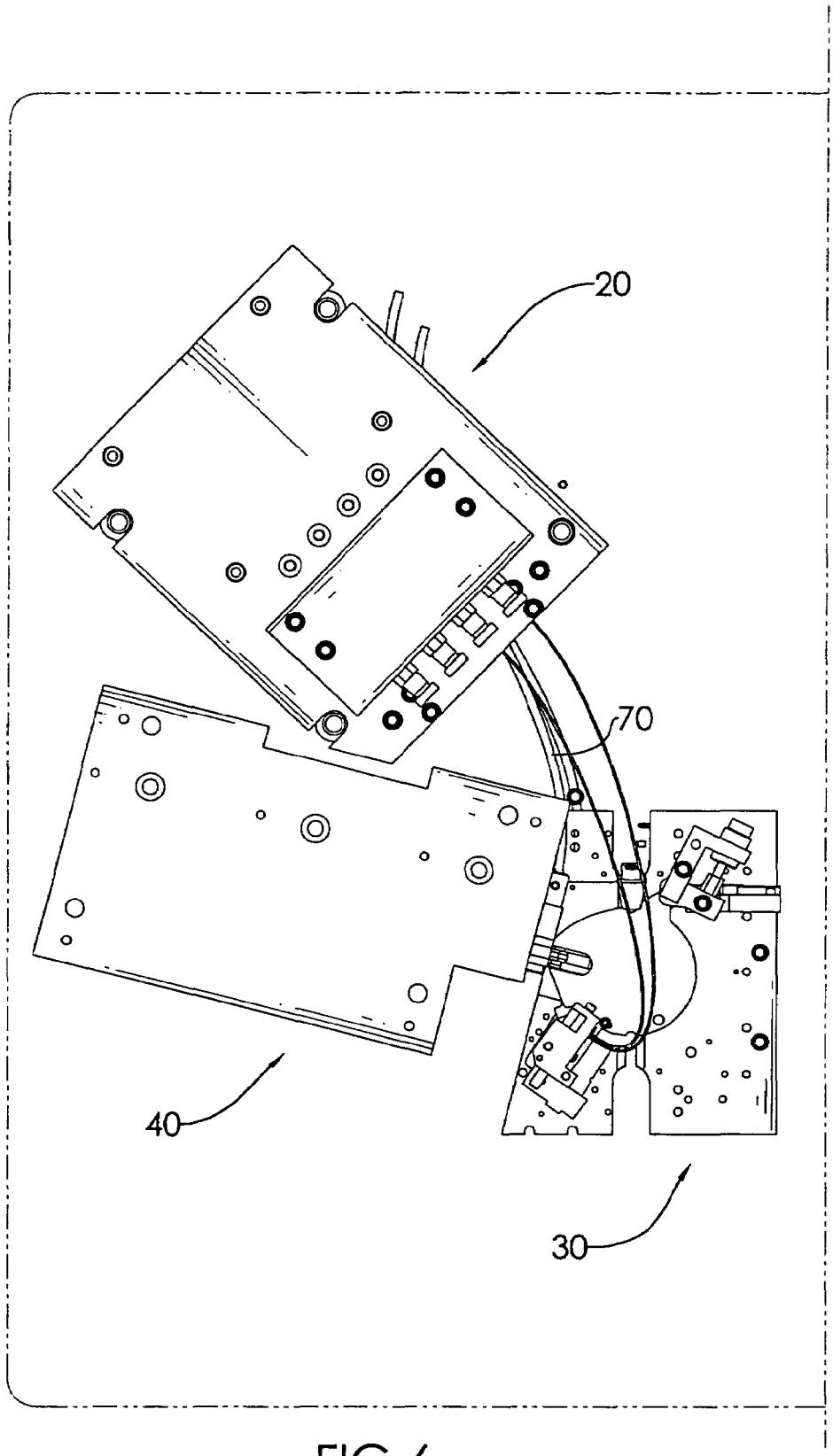
FIG. 6 is a bottom view of the wire winding device for electrical components in FIG. 1.

A sensor monitors the length of the wire which is inserted into the wire winding disk (32) and the PLC gets the feedback. With reference to FIG. 5, when the length of wire which is inserted into the wire winding disk (32) meets the predetermined demand, the first pressured cylinder (25) is pushed to resume the pushing shaft (251) to its original position so that the spring (222) pushes the disk (22) upwards. Hence, the supporting shaft (221) moves opposite to the first friction wheel (24) and the wire can not move via the rotation of the first friction wheel (24).

With reference to FIGS. 8, 9, 12 and 14, the wire is driven by the second friction wheels (34) to move in the wire winding member (30) and the wire cutting member (35) is driven by the PLC so that the wire is stopped by the second step (351) and moved into the wire-out gap (36). The first step (311) is flush with the second step (352) and the semi-circular post (334) is rotated by the PLC so that the wire cutting surface (335) is mated with the wire groove (330) to cut the wire.

With reference to FIGS. 11, 15, 17, 19-20, the third pressure cylinder (55) is driven by the PLC to resume the bar to an original position. The pushing plane (541) is pivoted to rotate the pivotal shaft (54) to drive the pivotal plane (542). Hence, the pivotal wheel (56) is separated from the fourth wheel (534) and mated with the sixth wheel (536). Therefore, the pivotal wheel (56) rotates relative to the second wheel (532) in a different direction and the upper driving wheel (431) rotates relative to the lower driving wheel (441) in a different direction. Hence, the upper wheel (43) rotates relative to the lower wheel (44) in a different direction so that the lower end of the upper wheel (43) rotates relative to the upper end of the lower wheel (44) in a same direction. Meanwhile, the needle (41) is driven to detach from the spool (60) so that the spool (60) is moved opposite to the cutout (321) and finish the process of wire winding automatically.

It is to be understood, however, that even though numerous characteristics and advantages of the present invention have been set forth in the foregoing description, together with details of the structure and function of the invention, the disclosure is illustrative only. Changes may be made in details, especially in matters of shape, size, and arrangement of parts within the principles of the invention to the full extent indicated by the broad general meaning of the terms in which the appended claims are expressed.

What is claimed is:

1. A wire winding device for electrical components comprising:

a transmission member having
- a first motor;
- a male wheel connected to the motor whereby the motor drives the male wheel;
- a wire feeding wheel and a wire winding wheel respectively mated with the male wheel; and
- a first and two second belt wheels respectively connected to the male wheel;

a wire-feeding member connected to the wire-feeding wheel and having
- a body;
- a first friction wheel rotatably mounted on the base,
- a third belt wheel connected to the first belt wheel via a first driving belt and connected to the first friction wheel,
- a disk pivotally mounted on the base,
- a supporting shaft mounted under the first friction wheel, and
- multiple soft tubes respectively mounted at the base and adjacent to the first friction wheel;

a wire-winding member connected to the wire winding wheel and having
- a support,
- a wire-winding disk mounted in the support,
- a first step formed in interconnecting surfaces of the support and the wire-winding disk,
- a block mounted in the support and connected to the soft tubes wherein the block extends from a lower end of the support to an upper end of the wire-winding disk, and having
  - a wire-cutting member mounted in a periphery of the block,
  - two second friction wheels respectively extending out of the support and opposite to each other and ends of the second friction wheels mounted on the first step,
  - two fourth belt wheels, each of which is connected to each of the second friction wheels, and connected to each of the second belt wheels via one of two second driving belt, and
  - a cutout defined in the periphery of the block;

a spool feeding member mounted to the support, corresponding to the cutout and having
- a box having
  - a spool inlet corresponding to the cutout and defined in a top end of the box,
  - a spool outlet defined in a side of the box,
  - an upper wheel mounted at an upper end of the cutout,
  - an upper driving wheel mounted on and mated with an upper end of the upper wheel,
  - two lower wheels mounted at a lower end of the cutout and unengaged with each other, and
  - a lower driving wheel mounted on and mated with a lower end of the lower wheel;

a driving member having
- a second motor,
- a wheel unit having
  - a first wheel connected to and driven by the second motor, a second wheel mated with the first wheel and connected to the upper driving wheel via a first soft driving shaft, a pivotal wheel connected to the lower driving wheel via a second soft driving shaft whereby the pivotal wheel is rotated relative to the second wheel in a same or a different direction.

2. The wire winding device for electrical components as claimed in claim 1, wherein multiple wire grooves are respectively defined in the block and a wire inlet and a wire outlet are respectively defined in two ends of each wire groove, each wire inlet is defined at the lower end of block that extends to a bottom of the support and each wire outlet is defined at an upper end of block that extends to a top of the support; the soft tubes respectively extend toward the wire inlets; the wire cutting element is pivotally mounted adjacent to the wire outlets; a semi-circular post is formed at an end of the wire cutting element which is inserted into the block and a wire cutting surface is formed at a side of the semi-circular post; a gap is defined in the periphery of the wire winding disk and apart from the cutout and the wire cutting member extends into the gap; a plane is formed at an end of the wire cutting member and lower than the periphery of the support; a second step is formed at a top end of the plane and corresponds to the first step; a wire-out gap is defined in the support and aims to the wire cutting member.

3. The wire winding device for electrical components as claimed in claim 1, wherein a spring is mounted in the wire feeding member and opposite to the supporting shaft, a first end of the spring is securely mounted in the wire feeding member and a second end of the spring is connected to a lower end of the disk; a first pressured cylinder is mounted in the wire feeding member and substantially under the supporting shaft; a pushing shaft is formed on and extends upward from a top end of the first pressured cylinder and extends toward the disk; a pressing shaft is mounted on the disk and between the spring and the supporting shaft.

4. The wire winding device for electrical components as claimed in claim 1, wherein the transmission member has two first flats; the male wheel, the wire feeding wheel and the wire winding wheel are respectively mounted at one of the first flats; the first motor is mounted between the first flats; a first and a second sector wheels are mated with each other, and the second sector is mounted at a bracket and a shaft is inserted through the bracket; a first axle is inserted through the first flats and a first end of the first axle is inserted into a center of the wire feeding wheel and a second end of the first axle is inserted into the first sector wheel; a first end of the shaft is inserted into the second sector wheel and a second end of the shaft is inserted into the first belt wheel; a second axle is inserted through the first flats and a first end of the second axle is inserted into the wire winding wheel and a second end of the second axle is inserted into a second belt wheel; a spindle is transversely formed on a center of the first friction wheel and extends out of the wire feeding member; the third belt wheel is mounted around the spindle and the first belt wheel and the third belt wheel are connected to each other via the first belt; the first belt wheel has a same diameter as that of the third belt wheel; two mandrels are respectively formed at ends of the second friction wheels and extend out of the support, two fourth belt wheels are respectively mounted around the mandrels; the second belt wheels have a bigger diameter than that of the fourth belts wheels.

5. The wire winding device for electrical components as claimed in claim 1, wherein the driving member is mounted at a side of a second flat and the second motor is mounted at the second flat and opposite to the spool-in member, the wheel unit is mounted at the second flat and adjacent to the spool-in member; the wheel unit has a third wheel, a fourth, a fifth wheel and a sixth wheel; the second wheel and the third wheel are respectively mated with the first wheel; the second wheel is mated with the fourth wheel while the third wheel is mated with the fifth wheel which is mated with the sixth wheel; a central spindle extends out of the second motor and inserted through the second flat; a pivotal shaft is inserted through the second flat and adjacent to the second motor and securely mounted at a pushing plane; a third pressured cylinder is mounted adjacent to the second motor and a bar extending out of the third pressured cylinder is connected to the pushing plane; a first end of a pivotal plane is connected to the pivotal shaft and a second end of the pivotal plane is connected to the pivotal wheel.

6. The wire winding device for electrical components as claimed in claim 1, wherein a needle is mounted in the support and inserted into the cutout.

7. The wire winding device for electrical components as claimed in claim 1, wherein a slot is defined in a periphery of the box; the spool inlet and the spool outlet respectively communicate with the slot; a pushing bar is connected to a second pressured cylinder and inserted into the spool inlet; a resilient piece is securely mounted in the box and has a curved end which is mounted between the slot and the spool inlet.

* * * * *